United States Patent [19]

Metz et al.

[11] 4,415,358

[45] Nov. 15, 1983

[54] METHOD OF DESULFURIZING A FERROUS MELT

[75] Inventors: Paul Metz, Luxembourg; Francois Schleimer, Esch/Alzette; Edouard Legille, Luxembourg; Jean Goedert, Esch/Alzette; Antoine Weiner, Luxembourg, all of Luxembourg

[73] Assignee: Arbed S.A., Luxembourg, Luxembourg

[21] Appl. No.: 371,439

[22] Filed: Apr. 23, 1982

[30] Foreign Application Priority Data

Apr. 24, 1981 [LU] Luxembourg ..... 83314

[51] Int. Cl.[3] ..... C21C 7/02

[52] U.S. Cl. ..... 75/58; 75/51; 75/52; 75/60

[58] Field of Search ..... 75/58, 60, 51, 52, 59

[56] References Cited

U.S. PATENT DOCUMENTS 3,484,232 12/1969 Karinthi ..... 75/59
3,574,596 4/1971 Lohman ..... 75/59
3,598,383 8/1971 Moore ..... 75/51
3,610,602 10/1971 Deacon ..... 75/59

*Primary Examiner*—P. D. Rosenberg
*Attorney, Agent, or Firm*—Karl F. Ross; Herbert Dubno

[57] ABSTRACT

A melt is contained in a vessel having below the level of the melt an at least gas-pervious wall portion. First the slag is removed, normally by pouring it off, from the melt. Then a finely divided treatment solids suspended in a gas is introduced through the wall portion into the melt. The melt reacts thoroughly with these solids. Immediately deslagging the melt substantially reduces its ability to pick up nitrogen or hydrogen. This can be enhanced by the further step, prior to introduction of the suspension, of adding pure lime to the melt to form a protective layer thereon. The vehicle gas for the powder of course is inert, normally argon. The vessel can also be sealed up with a tight cover after addition of pure lime to it and before introduction of the suspension. Otherwise in the subsequent desulfurizing nitrogen and hydrogen will enter into the metal matrix, especially if there is an appropriate slag present.

10 Claims, 2 Drawing Figures

METHOD OF DESULFURIZING A FERROUS MELT

CROSS REFERENCE TO RELATED APPLICATION

This application is related to the commonly assigned copending patent application Ser. No. 360,815 filed Mar. 22, 1982.

FIELD OF THE INVENTION

The present invention relates to a method of for desulfurizing a ferrous melt. More particularly, this invention concerns such a method which is used to treat a deoxidized steel melt.

BACKGROUND OF THE INVENTION

In the desulfurizing of a ferrous, normally steel, melt, a gaseous or solid additive must be thoroughly contacted with the melt. German patent document No. 2,209,902 filed Mar. 1, 1972 by H. Richter et al. describes a steel-refining process wherein calcium or calcium compounds such as CaO, $CaF_2$, Ca-Si, $CaC_2$ are blown by means of a lance in an inert vehicle gas, normally argon, into the melt which itself is held in a vessel lined with clay, magnesite, dolomite, or alumina-containing materials. The melt is covered with slag having at most 2% by weight FeO. Since calcium at refining temperatures of about 1600° C. has a vapor pressure of 2.13 atm, below a depth of 1.7 m this element is a liquid. Hence the lance normally projects down some 2 m into the melt, normally 2.6 m in a 4 m-deep vessel. The calcium therefore is liquefied and the liquid droplets rise slowly thereby entering into extremely intimate with the steel for efficient material use. The process is continued so that there is more than 0.015% by weight of aluminum in the metallic phase of the melt.

The lance has an extremely short service life. The conditions of heat and corrosion quickly destroy it. In addition, even in procedures other than desulfurizing, this lance is inconvenient and in the way.

It is also known to increase the carbon content of a steel melt, either to improve its quality or to generate heat by subsequent oxidation, by several techniques. Carbon can be introduced by lances in an inert carrier gas and/or a carbon-containing gas can be fed in to crack the melt and release carbon. Since carbon-containing gases normally also contain hydrogen, which cannot be permitted in steel, this latter procedure is rarely used. It is also possible, as suggested in German patent document No. 2,838,983 filed Sept. 7, 1978 by K. Brotzmann, to treat the melt by means of an oxygen jet played over the melt surface and carrying carbon or appropriate carbon compounds, or even to form such jets by nozzles immediately below the melt surface.

Another procedure uses nozzles provided on the floor of the vessel, and through which the additives are blown by means of a rotary air lock such as described in Luxembourg patent application No. 80,692, or in German patent documents Nos. 1,292,693 and 2,303,978 cited therein. Such nozzles must be made of very valuable material to last at least the life of the oven lining, so that they are very expensive. Furthermore something, if only an inert gas, must be fed in through them all the time to prevent the melt from entering and clogging them, as it is not necessary to continue the additive introduction through the entire life of the melt. Such use of gas can consume important quantities of these gases, which are not necessarily cheap.

Commonly owned Luxembourg Pat. Nos. 82,552, 82,553, 82,554, issued Jan. 20, 1982 and No. 82,597 issued Feb. 17, 1982 describe an insert which is part of the base of a metallurgical crucible. This insert is comprised largely of a sintered ceramic insert defining gas-flow channels. Treatment gases can be forced through such an insert to enter the melt at a very low level, but the small channel size of the insert and high surface tension of the melt prevent the melt from being able to flow back into the openings of the insert to block them. Thus this insert remains gas-pervious even if a gas is not forced through it for a while.

In addition Luxembourg patent application No. 82,977 describes a method for desulfurizing a ferrous melt without using synthetic slags. In accordance with this process the melt is first thoroughly deslagged and then a mixture of lime, clay, and metallic aluminum is blown into it by means of a lance opening some 1.50 m below the surface. About 1 kg–2 kg of lime is needed per ton of the iron in the melt to reduce the oxygen concentration to at most 35 ppm (parts per million). In order to compensate for the enormous heat losses caused by the loss of the slag and the passing of a great deal of vehicle gas for the powder through the melt during such a process, it is standard practice to electrically heat the melt.

Our above-cited earlier U.S. patent application describes a system wherein the melt-containing vessel has below the level of the melt a gas-pervious wall portion. A finely divided treatment solids is suspended in a gas which may be a treatment gas or simply an inert carrier and this suspension is introduced through the pervious wall portion into the melt to react the melt with the solids. The wall portion has channels oriented so that the gases and particles can pass into the vessel through them, but the molten metal therein cannot enter them. This system therefore avoids the preconception that it is only possible either to inject solids through a lance, or through expensive nozzles in the base of the crucible. The earlier invention is based on the surprising fact that a good crucible-lining stone can be made which passes both gas and finely divided solids, but not liquid steel.

This earlier patent aplication further suggests how a plurality of such gas- and particle-pervious inserts are provided in the base of the crucible. They can be individually controlled relative to respective sensors provided above the melt. Thus exothermically reacting gases and/or particles are fed in under cold spots, or endothermically reacting gases and/or particles are fed in under hot spots. Normally carbon is blown in mainly at the melt center where it is hottest. In addition when the vessel has a plurality of such pervious wall portions, the method further comprises the step of detecting the melt temperature at respective locations above the portions and introducing the suspension through the respective inserts in accordance with the detected temperature. It is also possible to vary the reactivity of the gases and/or solids fed in to regulate the melt temperature at the various zones in accordance with our earlier invention.

The apparatus according to our earlier invention therefore has a vessel containing the melt and having below the level of the melt an at least gas-pervious wall portion and means for suspending finely divided treatment solids in a gas and forcing the suspension through the wall portion into the melt, whereby the solids react with the melt. The gas-pervious wall portion is an insert of a porous ceramic. More particularly this insert has a plurality of blocks of the ceramic, metal plates separating the blocks, and an adhesive or mortar securing the blocks to the plates. The suspending means of the includes a rotary air lock.

When the system of our earlier invention is used in an electric-arc furnace for making alloyed steel, the alloying elements are introduced in a distribution or alternately with reacting gases to obtain the desired mixing in the melt. The same procedure applies to deoxidization processes. In order to desulfurize a melt a crucible with a basic lining is used to contain the melt which is completely covered by an appropriate slag. First pure lime is fed in from the bottom through a powder-porous insert. This lime can be carried on an inert gas such as argon so that the melt is covered and cannot pick up oxygen and nitrogen from the air. The input of lime only is stopped and the same feed arrangement introduces a mixture of lime and powdered metallic aluminum to deoxidize the melt. Finally a mixture of lime, calcium floride, and even calcium carbide is introduced through the bottom insert so as to greatly reduce the sulfur content as well as the inclusions.

OBJECTS OF THE INVENTION

It is therefore an object of the present invention to advance the principles of our above-cited copending application and to provide an improved method of and apparatus for desulfurizing a ferrous melt.

Another object is the provision of such a method of and apparatus for desulfurizing a ferrous melt which overcome the above-given disadvantages.

A further object is to provide such a process which avoids the large heat losses of the lance-type system.

SUMMARY OF THE INVENTION

These objects are attained according to the instant invention in a method wherein the melt is contained in a vessel having below the level of the melt an at least gas-pervious wall portion. According to this invention first the slag is removed, normally by pouring it off, from the melt. Then a finely divided treatment solid suspended in a gas is introduced through the wall portion into the melt. The melt reacts thoroughly with these solids.

Immediately deslagging the melt substantially reduces its ability to pick up nitrogen or hydrogen. This can be enhanced by the further step, prior to introduction of the suspension, of adding pure lime to the melt to form a protective layer thereon. The vehicle gas for the powder of course is inert, normally argon. It is also possible according to this invention to seal up the vessel with a tight cover after addition of pure lime to it and before introduction of the suspension. Such a cover only has holes for sensors that determine melt temperature and oxygen concentration. Otherwise in the subsequent desulfurizing nitrogen and hydrogen will enter into the metal matrix, especially if there is an appropriate slag present.

The solids which are added in accordance with this invention include a mixture of metallic-aluminum and lime particles in a ratio of between 1:1 and 1:5. They are added until the oxygen concentration of the melt is reduced to at most 35 ppm. More particularly such solids include by weight 0–30% metallic aluminum, 0–20% calcium fluoride, and 50–100% lime. Normally the lime is more concentrated at the beginning and the aluminum at the end. The the solids are held in a supply, whose weight is continuously moinitored to determine the amount of solids used.

When the vessel as a floor provided with a plurality of such gas- and powder-pervious wall portions, the method further comprises the step of individually controlling the feed of the suspension to the portions. More particularly the temperature of the melt is monitored above each location and the respective solids feed is varied in accordance with the respective detected temperature. Exothermically reacting solids are added to cool spots and endothermically reacting ones to hot spots.

Although it is possible to vary the flow rate of the inert gas to vary the feed rate of the solids, normally according to this invention the flow rate of the inert gas is maintained constant and the feed rate of the solids is varied, normally by being decreased after the start. The system of the instant invention is, however, quite flexible so that the solids feed can even be shut off at some times.

The apparatus according to the instant invention is constituted much as in our earlier invention and comprises a vessel containing the melt and having below the level of the melt an at least gas-pervious wall portion, and means for suspending finely divided treatment solids in a gas and forcing the suspension through the wall portion into the melt. This means for suspending includes a rotary air lock such as described in above-cited Luxembourg patent application No. 80,692.

DESCRIPTION OF THE DRAWING

The above and other features and advantages will become more readily apparent from the following description and example, reference being made to the accompanying drawing in which.

SPECIFIC DESCRIPTION

Figure 1:
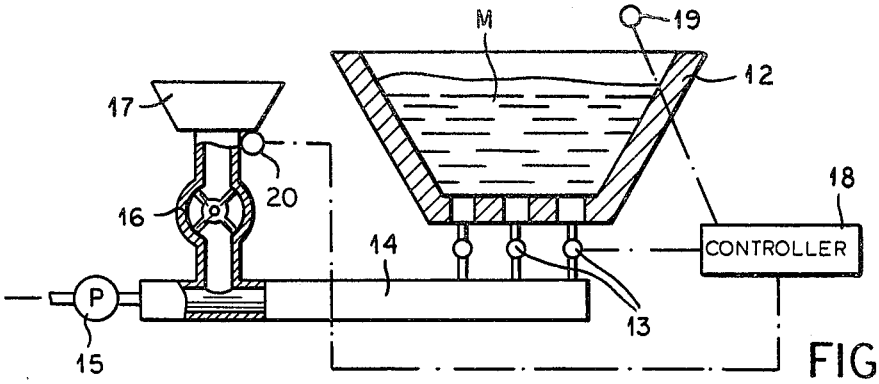
FIG. 1 is a side partly sectional and diagrammatic view of the system of this invention.

As seen in FIG. 1 a crucible 12 filled with a melt M has a floor provided with a plurality of throughgoing inserts 1 each having a feed tube 10 connected to a valve 13 fed in turn off a manifold 14. A pump 15 feeds an inert or treatment gas to the far end of this manifold 14, immediately upstream of a rotary air lock 16 that receives finely divided particulate material from a silo or supply 17. The lock 16 is of the type described in above-cited Luxembourg patent application No. 82,692. The valves 13 are all operated by a controller 18 having one or more sensors 19 that can determined the composition and temperature of gases emanating from the top of the melt M. In addition the controller has a sensor 20 which is used to determine the weight of the supply 17 so that the consumption of the solids can be monitored.

Figure 2:
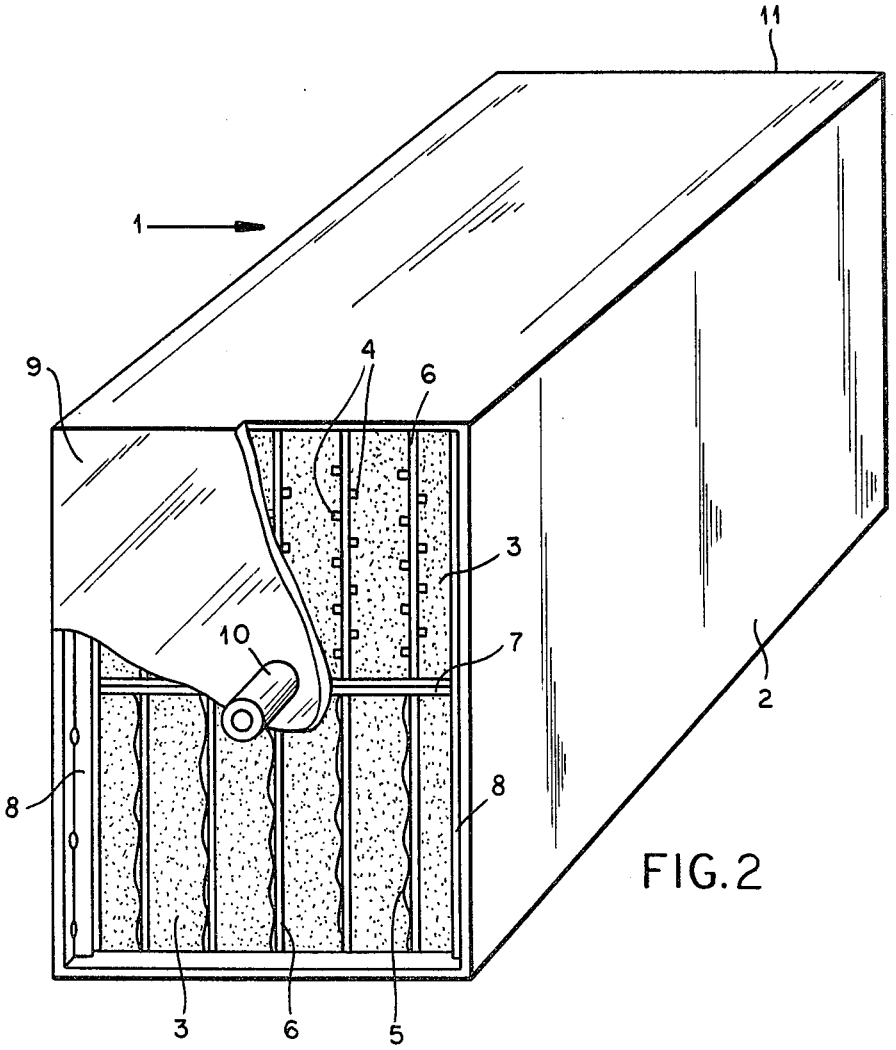
FIG. 2 is a large-scale and partly broken-away perspective view of a pervious insert according to the invention.

FIG. 2 shows the inserts 1, which correspond to the type described in the commonly owned above-cited Luxembourg Pat. Nos. 82,552, 82,553, 82,554, and 82,597. Each insert 1 has a square-section tubular metal housing 2 containing twelve longitudinally throughgoing ceramic insert blocks or segments 3 of rectangular section and arranged in two rows of six each. Each segment 3 has at least one longitudinally extending side formed with longitudinally throughgoing grooves, or has a wavy side edge 5 defining the channels through which the particle-entraining gas is fed. Adjacent segments 3 are separated by flat metal plates 5, with pairs of such plates 7 provided between the two rows. An appropriate mortar secures the segments to the plates 6 and 7, completely filling the spaces therebetween to prevent gas flow along the interface between the segments 3 and plates 6 and 7. Spacers 8 keep the ends of the segments spaced slightly from an end wall 9 through which the feed pipe 10 feeds a suspension of gas and particles to the insert 1, so that gas and finely divided particles can pass through the channels of segments 3 and exit from the opposite ends 11 thereof.

The segments or blocks 3 are of sintered ceramic construction and may have composition described in detail in the parent application.

In addition the system is operated generally in accordance with the specific Example given in that application, which does cite commonly owned Luxembourg Pat. No. 81,207.

The system according to the instant invention therefore considerably advances the principles discussed in our above-cited copending patent application.

We claim:

1. A method of desulfurizing a deoxidized ferrous metal melt having a covering of slag, said method comprising the steps of:

containing said melt in a vessel having below the level of said melt a refractory gas-pervious wall portion provided with channels impenetrable by liquid metal of the melt;

removing the slag from said melt;

suspending finely divided desulfurizing treatment solids in a gas; and introducing the suspension through said wall portion via said channels into said melt and reacting said melt with said solids after the removal of the slag.

2. The method defined in claim 1, further comprising the step, prior to introduction of said suspension but after the removal of the slag, of adding pure lime to said melt to form a protective layer thereon, said gas being inert.

3. The method defined in claim 2, further comprising covering said vessel with a tight cover after addition of pure lime to it and before introduction of said suspension.

4. The method defined in claim 1 wherein said solids include a mixture of metallic-aluminum and lime particles in a ratio of between 1:1 and 1:5 and said solids are added until the oxygen concentration of said melt is reduced to at most 35 ppm.

5. The method defined in claim 1 wherein said solids include by weight:

0–30%: metallic aluminum

0–20%: calcium fluoride

50–100%: lime.

6. The method defined in claim 4 wherein said solids are held in a supply, said method further comprising the step of continuously monitoring the weight of said supply to determine the amount of solids used.

7. The method defined in claim 1 wherein said vessel has a floor provided with a plurality of such wall portions, said method further comprising the step of individually controlling the feed of said suspension to said portions.

8. The method defined in claim 7, further comprising the method of monitoring the temperature of said melt above each of said locations and varying the feed of said solids to the respective locations in accordance with the respective detected temperature.

9. The method defined in claim 1, further comprising the step of varying the flow rate of said inert gas to vary the feed rate of said solids.

10. The method defined in claim 1, further comprising the step of maintaining the flow rate of said inert gas constant and varying the feed rate of said solids.

* * * * *